US008092161B2

(12) United States Patent
Cai et al.

(10) Patent No.: US 8,092,161 B2
(45) Date of Patent: Jan. 10, 2012

(54) THERMAL SHIELD AT CASING JOINT

(75) Inventors: Weidong Cai, Oviedo, FL (US); David M. Parker, Oviedo, FL (US)

(73) Assignee: Siemens Energy, Inc., Orlando, FL (US)

( * ) Notice: Subject to any disclaimer, the term of this patent is extended or adjusted under 35 U.S.C. 154(b) by 485 days.

(21) Appl. No.: 12/355,025

(22) Filed: Jan. 16, 2009

(65) Prior Publication Data

US 2010/0074735 A1 Mar. 25, 2010

Related U.S. Application Data

(60) Provisional application No. 61/099,678, filed on Sep. 24, 2008.

(51) Int. Cl.
*F01D 5/08* (2006.01)
*F01D 5/18* (2006.01)

(52) U.S. Cl. ..... 415/175; 415/114; 415/177

(58) Field of Classification Search ..... 415/114, 415/115, 116, 175, 177, 178
See application file for complete search history.

(56) References Cited

U.S. PATENT DOCUMENTS 3,736,069 A 5/1973 Beam, Jr. et al.
4,405,284 A 9/1983 Albrecht et al.
4,522,559 A 6/1985 Burge et al.
5,174,714 A * 12/1992 Plemmons et al. ..... 415/177
5,195,868 A * 3/1993 Plemmons et al. ..... 415/177
5,273,397 A 12/1993 Czachor et al.
5,758,503 A 6/1998 DuBell et al.
6,122,917 A 9/2000 Senior
6,164,075 A 12/2000 Igarashi et al.
6,173,561 B1 1/2001 Sato et al.
6,282,905 B1 9/2001 Sato et al.
6,322,320 B1 11/2001 Pfeiffer et al.
6,679,045 B2 * 1/2004 Karafillis et al. ..... 60/39.08
6,786,052 B2 9/2004 Doody
7,065,971 B2 6/2006 Bellucci et al.

* cited by examiner

*Primary Examiner* — David Nhu

(57) ABSTRACT

A thermal shield for reducing thermal stress induced proximate to a first joint formed between adjacent engine casing components in a gas turbine engine. The thermal shield includes a cover structure for covering a radially inner portion of at least one of the engine casing components. The cover structure is disposed proximate to the first joint and attached to the respective engine casing component so as to limit exposure of a covered inner portion of the engine casing component to hot gases in an interior volume defined by the engine casing components. A thermally insulating layer is disposed between the cover structure and the engine casing component for effecting a reduced amount of heat transfer to the covered inner portion of the engine casing component from the hot gases in the interior volume defined by the engine casing components.

20 Claims, 6 Drawing Sheets

THERMAL SHIELD AT CASING JOINT

CROSS-REFERENCE TO RELATED APPLICATION

This application claims the benefit of U.S. Provisional Application Ser. No. 61/099,678 entitled THERMAL SHIELD AT CASING JOINT, filed Sep. 24, 2008, the entire disclosure of which is incorporated by reference herein.

FIELD OF THE INVENTION

The present invention relates to gas turbine engines and, more particularly, to thermal shields for use on engine casing components for reducing thermal stress induced on covered portions of the engine casing components.

BACKGROUND OF THE INVENTION

Generally, gas turbine engines have three main sections or assemblies, including a compressor assembly, a combustor assembly, and a turbine assembly. In operation, the compressor assembly compresses ambient air. The compressed air is channeled into the combustor assembly where it is mixed with a fuel and ignites, creating a heated working gas. The heated working gas is expanded through the turbine assembly. The turbine assembly generally includes a rotating assembly comprising a centrally located rotating rotor and a plurality of rows of rotating blades attached thereto. A plurality of stationary vane assemblies, each including a plurality of stationary vanes, are connected to a casing of the turbine assembly and are located interposed between the rows of rotating blades. The expansion of the working gas through the rows of rotating blades and stationary vanes in the turbine assembly results in a transfer of energy from the working gas to the rotating assembly, causing rotation of the rotor. The rotor further supports rotating compressor blades in the compressor assembly, such that a portion of the output power from rotation of the rotor is used to rotate the compressor blades to provide compressed air to the combustor assembly.

It has been determined that during engine load-up and shut down procedures, high amounts of stress induced by a thermal gradient may cause cracking of the engine casing proximate to an interface between a compressor/combustor casing and the turbine casing. Specifically, during engine load-up, the temperature of air inside the engine casing proximate to the interface between the compressor/combustor casing and the turbine casing rises very quickly, i.e., the temperature increases from ambient temperature to around 400° Celsius in about 20 minutes, while the temperature of the air outside of the engine casing rises much more slowly, i.e., the temperature may take several hours to substantially increase. Since cracking of the engine casing may result in expensive and time consuming repair procedures, it would be desirable to provide a structure for reducing the amount of stress induced on the engine casing in the areas susceptible to the cracking.

SUMMARY OF THE INVENTION

In accordance with a first aspect of the present invention, a thermal shield is provided for reducing thermal stress induced proximate to a first joint formed between adjacent engine casing components in a gas turbine engine. The thermal shield comprises a cover structure and a thermally insulating layer. The cover structure covers a radially inner portion of at least one of the engine casing components and is disposed proximate to the first joint. The cover structure is attached to a radially inner side of the respective engine casing component so as to limit exposure of the covered inner portion of the respective engine casing component to hot gases in an interior volume defined by the engine casing components. The thermally insulating layer is located between the cover structure and the covered inner portion of the respective engine casing component. The thermally insulating layer effects a reduced amount of heat transfer to the covered inner portion of the respective engine casing component from the hot gases in the interior volume defined by the engine casing components.

In accordance with a second aspect of the present invention, an engine casing is provided for use in a gas turbine engine. The engine casing comprises two axially adjacent engine casing structures cooperating to form a substantially cylindrical member defining an interior volume therein. Each engine casing structure is comprised of at least one circumferential engine casing component. A circumferentially extending joint is formed between the engine casing structures. The engine casing further comprises at least one thermal shield for reducing thermal stress induced on a portion of at least one of the engine casing components of the engine casing structures proximate to the circumferentially extending joint. The thermal shield comprises a cover structure for covering a radially inner portion of the at least one of the engine casing components and a thermally insulating layer. The cover structure is disposed proximate to the circumferentially extending joint and is attached to a radially inner side of the respective engine casing component so as to limit exposure of the covered inner portion of the respective engine casing component to hot gases in the interior volume defined by the engine casing structures. The thermally insulating layer is located between the cover structure and the covered inner portion of the respective engine casing component. The thermally insulating layer effects a reduced amount of heat transfer to the covered inner portion of the respective engine casing component from the hot gases in the interior volume defined by the engine casing structures.

In accordance with yet another aspect of the present invention, an engine casing is provided for use in a gas turbine engine. The engine casing comprises a first engine casing structure and a second engine casing structure. The first engine casing structure comprises at least two first engine casing components, wherein an axially extending joint is formed between each of the first engine casing components. The second engine casing structure is disposed axially adjacent to the first engine casing structure and comprises at least two second engine casing components. An axially extending joint is formed between each of the second engine casing components. The first and second engine casing structures cooperate to define an interior volume therein, wherein a circumferentially extending joint is formed between the first and second engine casing structures. Each of the first engine casing components and each of the second engine casing components has a respective thermal shield associated with it for reducing thermal stress induced on the first and second engine casing components. Each of the thermal shields comprises a cover structure for covering a radially inner portion of the respective engine casing component. The cover structure is disposed proximate to the circumferentially extending joint between the first and second engine casing structures and also proximate to the axially extending joint between the respective engine casing components. The cover structure is attached to a radially inner side of the respective engine casing component so as to limit exposure of the covered inner portion of the respective engine casing component to hot gases in the interior volume defined by the engine casing structures.

BRIEF DESCRIPTION OF THE DRAWINGS

While the specification concludes with claims particularly pointing out and distinctly claiming the present invention, it is believed that the present invention will be better understood from the following description in conjunction with the accompanying Drawing Figures, in which like reference numerals identify like elements, and wherein:

DETAILED DESCRIPTION OF THE INVENTION

In the following detailed description of the preferred embodiments, reference is made to the accompanying drawings that form a part hereof, and in which is shown by way of illustration, and not by way of limitation, specific preferred embodiments in which the invention may be practiced. It is to be understood that other embodiments may be utilized and that changes may be made without departing from the spirit and scope of the present invention.

Figure 1:
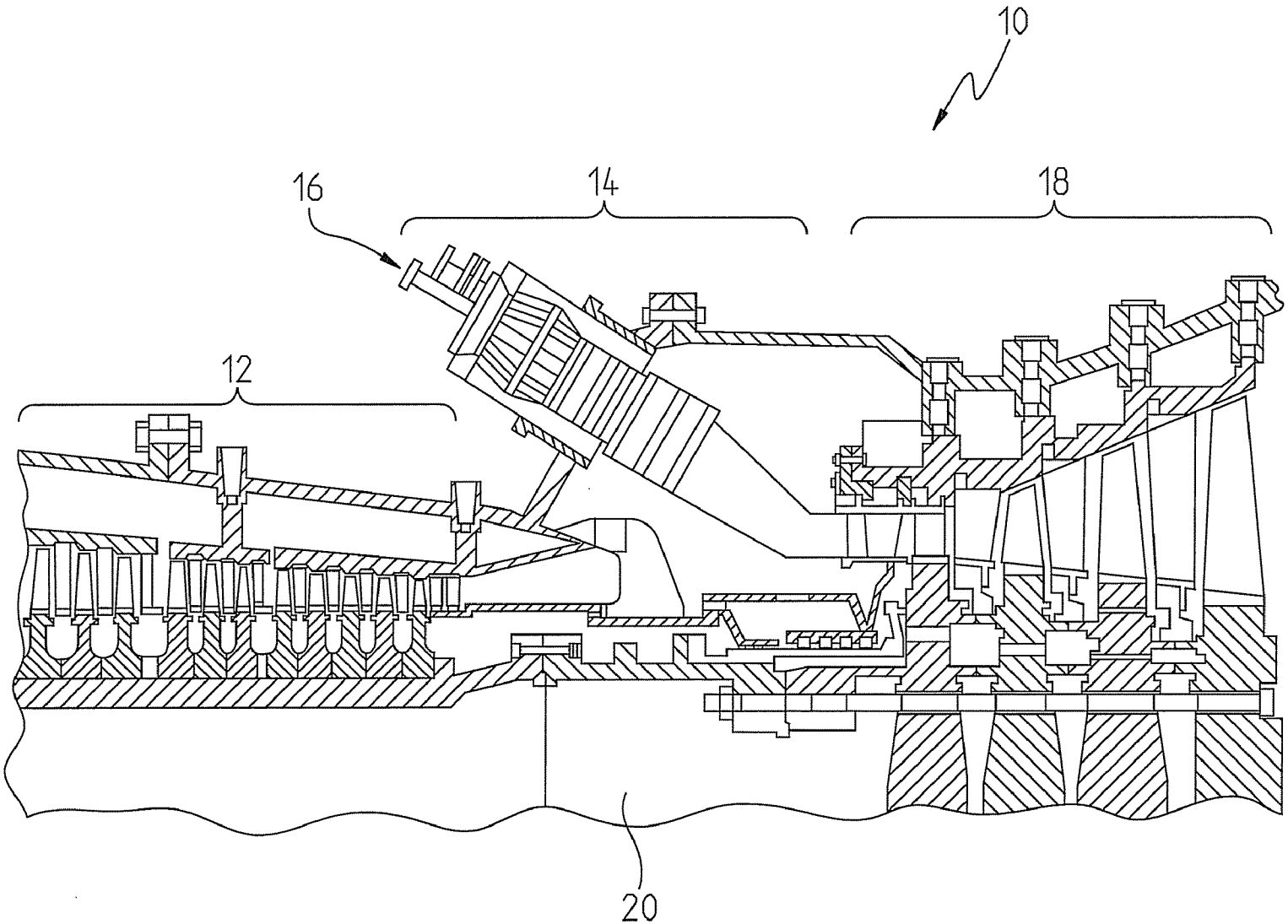
FIG. 1 is a sectional view of a portion of a gas turbine engine according to an embodiment of the invention.

Referring to FIG. 1, a portion of a gas turbine engine 10 is shown. The engine 10 includes a compressor section 12, a combustion section 14 including a plurality of combustors 16, and a turbine section 18. The compressor section 12 inducts and pressurizes inlet air which is directed to the combustors 16 in the combustion section 14. Upon entering the combustors 16, the compressed air from the compressor section 12 is mixed with a fuel and ignited to produce a high temperature and high velocity combustion gas flowing in a turbulent manner. The combustion gas then flows to the turbine section 18 where the combustion gas is expanded to provide rotation of a turbine rotor 20.

Figure 2:
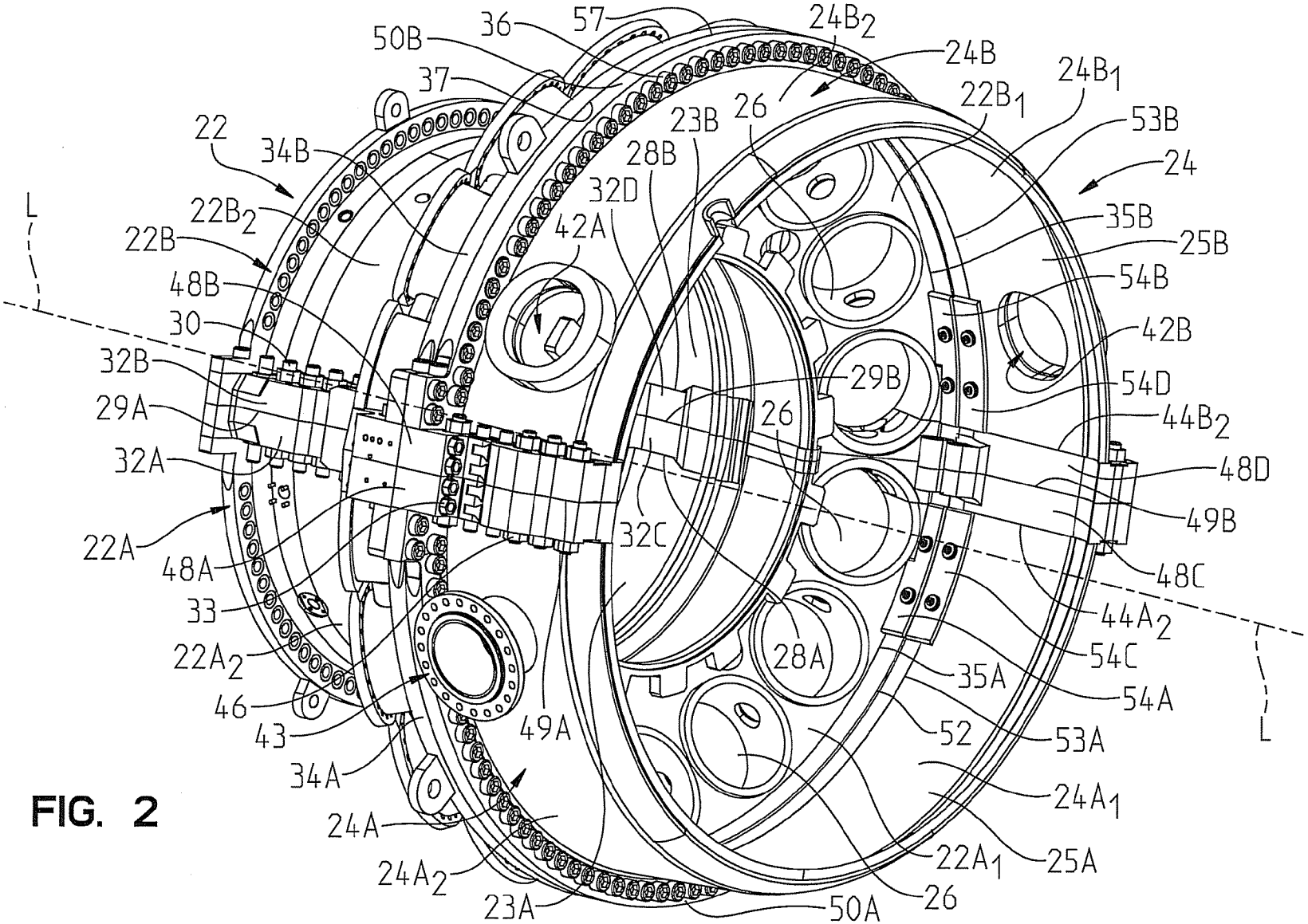
FIG. 2 is a perspective view of portions of a compressor/combustor casing and a turbine casing including a plurality of thermal shields according to an embodiment of the invention.

Referring to FIG. 2, a compressor/combustor cylinder or compressor/combustor (hereinafter "C/C") casing 22 and a turbine cylinder or turbine casing 24 are shown. The C/C casing 22 comprises first and second C/C casing components 22A, 22B disposed about a longitudinal axis L of the engine 10, but may comprise any suitable number of C/C casing components, including a single or unitary C/C casing component forming the C/C casing 22. The C/C components 22A, 22B may be formed from any suitable high strength and heat tolerant material, such as, for example, carbon steel. The C/C casing components 22A, 22B each define respective radially inner surfaces $22A_1$, $22B_1$ and opposed radially outer surfaces $22A_2$, $22B_2$. Each C/C casing component 22A, 22B is formed with a plurality of openings 26 extending between the inner and outer surfaces $22A_1$, $22B_1$ and $22A_2$, $22B_2$ for receiving the combustors 16 (which combustors 16 are not shown in FIG. 2 for clarity).

The first C/C casing component 22A comprises a first C/C casing main body 23A, and first axial C/C casing flanges 32A, 32C attached to the first C/C casing main body 23A at axial C/C casing joints 28A (only joint 28A between the first C/C casing main body 23A and the flange 32C is shown). The first C/C casing component 22A further comprises a circumferentially extending first radial C/C casing flange 34A attached to the first C/C casing main body 23A at a circumferential C/C casing joint 35A. The first radial C/C casing flange 34A defines, with aft ends of the first axial C/C casing flanges 32A, 32C, an axially aft end of the first C/C casing component 22A.

The second C/C casing component 22B comprises a second C/C casing main body 23B, and second axial C/C casing flanges 32B, 32D attached to the second C/C casing main body 23B at axial C/C casing joints 28B (only joint 28B between the second C/C casing main body 23B and the flange 32D is shown). The second C/C casing component 22B further comprises a circumferentially extending second radial C/C casing flange 34B attached to the second C/C casing main body 23B at a circumferential C/C casing joint 35B. The second radial C/C casing flange 34B defines, with aft ends of the second axial C/C casing flanges 32B, 32D, an axially aft end of the second C/C casing component 22B.

The axial C/C casing joints 28A, 28B and circumferential C/C casing joints 35A, 35B may be formed by any suitable means for joining the adjacent parts forming the C/C casing components 22A, 22B, such as, for example, by welding. It is also noted that the axial C/C casing flanges 32A, 32C and 32B, 32D and radial C/C casing flanges 34A and 34B may be integrally formed with the respective first and second C/C casing components 22A and 22B.

The C/C components 22A, 22B cooperate to define the C/C casing 22 as a generally cylindrical member. In particular, the pair of adjacent first and second axial C/C casing flanges 32A and 32B are mated to each other at a first axial C/C casing joint or junction 29A, and the pair of adjacent first and second axial C/C casing flanges 32C and 32D are mated to each other at a second axial C/C casing joint or junction 29B. The pairs of axial C/C casing flanges 32A, 32B and 32C, 32D each comprise a radially outwardly extending portion having apertures (not shown) for receiving casing bolts 30 to affix the pairs of adjacent axial C/C casing flanges 32A, 32B and 32C, 32D together at the respective C/C casing junctions 29A, 29B, as shown in FIG. 2.

The radial C/C casing flanges 34A, 34B of the joined C/C casing components 22A, 22B define an aft end 37 of the C/C casing 22. The aft end 37 of the C/C casing 22 mates to a forward end 57 of the turbine casing 24 at a circumferential joint or junction 52, as will be described further below.

As is further shown in FIG. 2, the turbine casing 24 comprises first and second turbine casing components 24A, 24B disposed about the longitudinal axis L of the engine 10, but may comprise any suitable number of turbine casing components, including a single or unitary turbine casing component. The turbine casing components 24A, 24B may be formed from any suitable high strength and heat tolerant material, such as, for example, carbon steel. The turbine casing components 24A, 24B are mated to one another, as is described further below, to form a generally cylindrical member that cooperates with the C/C casing 22 to define an inner volume for receiving compressor discharge air. The turbine casing components 24A, 24B each define respective radially inner surfaces $24A_1$, $24B_1$ and opposed radially outer surfaces $24A_2$, $24B_2$. The first turbine casing component 24A includes two openings 42A, 42B or man ways extending between the inner and outer surfaces $24A_1$ and $24A_2$, which function, for example, to allow an individual to enter the turbine casing 24, i.e., for servicing the turbine casing 24 and or C/C casing 22. The second turbine casing component 24B includes an air extraction conduit 43 extending between the inner and outer surfaces $24B_1$ and $24B_2$ for extracting air, such as, for example, the compressor discharge air in the inner volume defined by the C/C casing 22 and the turbine casing 24.

Figure 3:
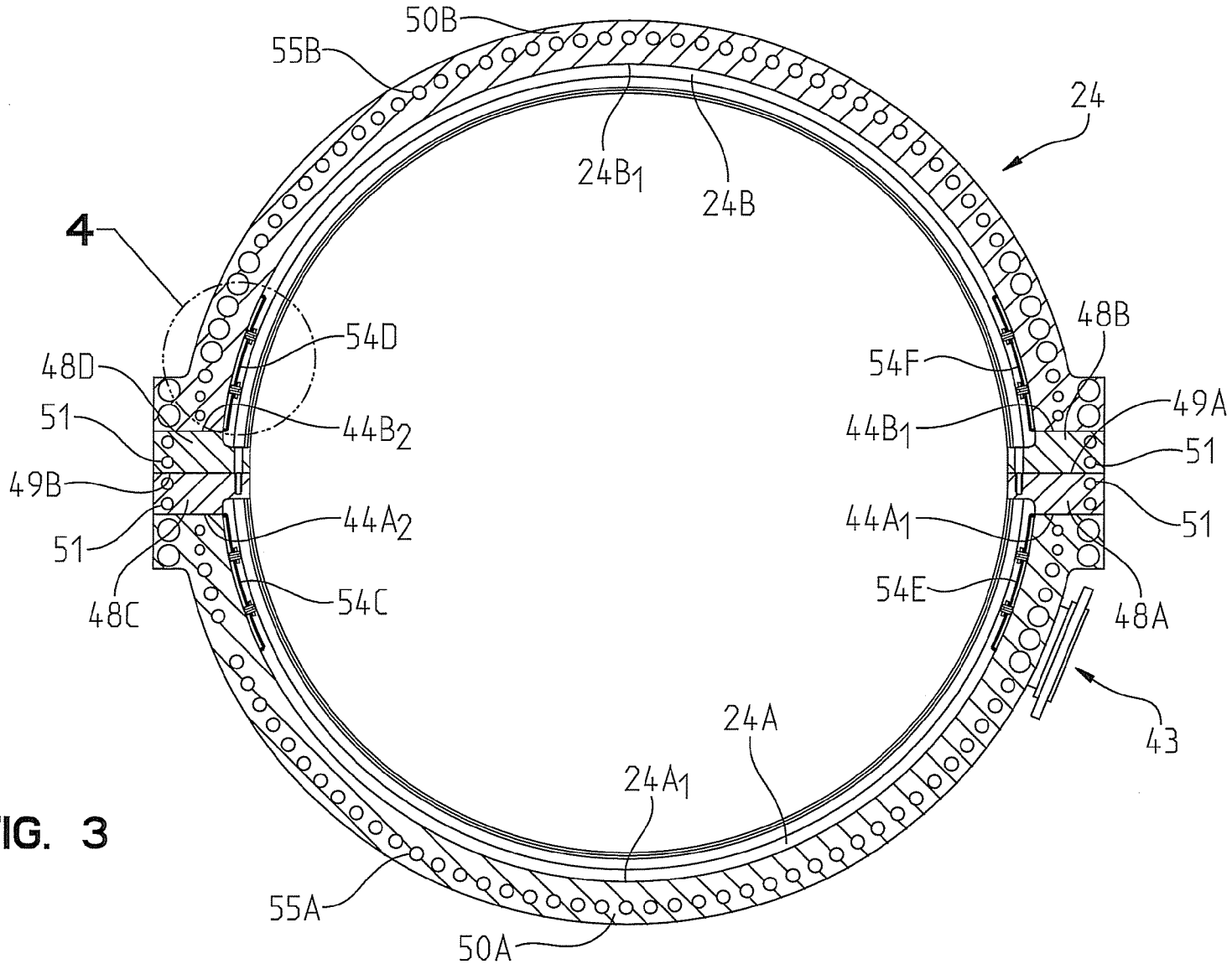
FIG. 3 is an axial cross sectional view of the turbine casing and a plurality of the thermal shields illustrated in FIG. 2.

The first turbine casing component 24A comprises a first turbine casing main body 25A, and first axial turbine casing flanges 48A, 48C attached to the first turbine casing main body 25A at axial turbine casing joints $44A_1$, $44A_2$ (see FIGS. 2 and 3). The first turbine casing component 24A further comprises a circumferentially extending first radial turbine casing flange 50A attached to the first turbine casing main body 25A at a circumferential turbine casing joint 53A. The first radial turbine casing flange 50A defines, with forward ends of the first axial turbine casing flanges 48A, 48C, an axially forward end of the first turbine casing component 24A.

The second turbine casing component 24B comprises a second turbine casing main body 25B, and axial turbine casing flanges 48B, 48D attached to the second turbine casing main body 25B at axial turbine casing joints $44B_1$, $44B_2$ (see FIGS. 2 and 3). The second turbine casing component 24B further comprises a circumferentially extending radial turbine casing flange 50B attached to the second turbine casing main body 25B at a circumferential turbine casing joint 53B. The second radial turbine casing flange 50B defines, with forward ends of the second axial turbine casing flanges 48B, 48D, an axially forward end of the second turbine casing component 24B.

The axial turbine casing joints $44A_1$, $44A_2$, $44B_1$, $44B_2$ and circumferential turbine casing joints 53A, 53B may be formed by any suitable means for joining the adjacent parts forming the turbine casing components 24A, 24B, such as, for example, by welding. It is also noted that the axial turbine casing flanges 48A, 48C and 48B, 48D and the radial turbine casing flanges 50A and 50B may be integrally formed with the respective first and second turbine casing components 24A and 24B.

As noted above, the turbine casing components 24A, 24B cooperate to define the turbine casing 24 as a generally cylindrical member. In particular, the pair of adjacent first and second axial turbine casing flanges 48A and 48B are mated to each other at a first axial turbine casing joint or junction 49A, and the pair of adjacent first and second axial turbine casing flanges 48C and 48D are mated to each other at a second axial turbine casing joint or junction 49B. The pairs of axial turbine casing flanges 48A, 48B and 48C, 48D each comprise a radially outwardly extending portion having apertures (not shown) for receiving casing bolts 46 to affix the pairs of adjacent axial turbine casing flanges 48A, 48B and 48C, 48D together at the respective turbine casing junctions 49A, 49B, as shown in FIG. 2.

The radial turbine casing flanges 50A, 50B of the joined turbine casing components 24A, 24B define the forward end 57 of the turbine casing 24. The vertical turbine casing flanges 50A and 50B include respective arrays of apertures 55A and 55B (see FIG. 3). The apertures 55A, 55B receive fastening devices 36, such as bolts, that secure the C/C casing aft end 37 to the forward end 57 of the turbine casing 24 to define a circumferential joint or junction 52 at an interface between the C/C casing aft end 37 and the turbine casing forward end 57. The circumferential junction 52 extends around the entire interface between the C/C casing aft end 37 and the turbine casing forward end 57.

Referring to FIGS. 2 and 3, eight thermal shields 54A, 54B (see FIG. 2), 54C, 54D, 54E, 54F (see FIG. 3) (note that the seventh and eighth thermal shields are hidden from view in the drawings) are each associated with a respective one of the C/C casing 22 and the turbine casing 24. Specifically, a first thermal shield 54A (FIG. 2) and a seventh thermal shield (not shown) are associated with the first C/C casing component 22A; a second thermal shield 54B (FIG. 2) and an eighth thermal shield (not shown) are associated with the second C/C casing component 22B; a third thermal shield 54C (FIG. 3) and fifth thermal shield 54E (FIG. 3) are associated with the first turbine casing component 24A; and a fourth thermal shield 54D (FIG. 3) and a sixth thermal shield 54F are associated with the second turbine casing component 24B. The thermal shields 54A, 54B, 54C, 54D, 54E, 54F are attached to their respective C/C or turbine casing 22, 24 over a respective covered portion of the C/C or turbine casing 22, 24.

The covered portion(s) of the C/C casing 22 may comprise, for example, a portion of one or more of the radially inner surfaces $22A_1$, $22B_1$ of the casing components 22A, 22B proximate to a respective one or more of the axially extending C/C casing joints 28A, 28B or junctions 29A, 29B, and/or proximate to a respective one or more of the circumferentially extending C/C casing joints 35A, 35B and/or the junction 52. In a preferred embodiment, the covered portions of the C/C casing components 22A, 22B comprise portions proximate to both the circumferentially extending junction 52 and the respective axially extending C/C casing junctions 29A, 29B. Similarly, the covered portion(s) of the turbine casing 22 may comprise, for example, a portion of one or more of the radially inner surfaces $24A_1$, $24B_1$ of the casing components 24A, 24B proximate to a respective one or more of the axially extending turbine casing joints $44A_1$, $44A_2$, $44B_1$, $44B_2$ or junctions 49A, 49B, and/or proximate to a respective one or more of the circumferentially extending turbine casing joints 53A, 53B and/or the junction 52. In a preferred embodiment, the covered portions of the turbine casing components 24A, 24B comprise portions proximate to both the circumferentially extending junction 52 and the respective axially extending turbine casing junctions 49A, 49B.

Figure 4:
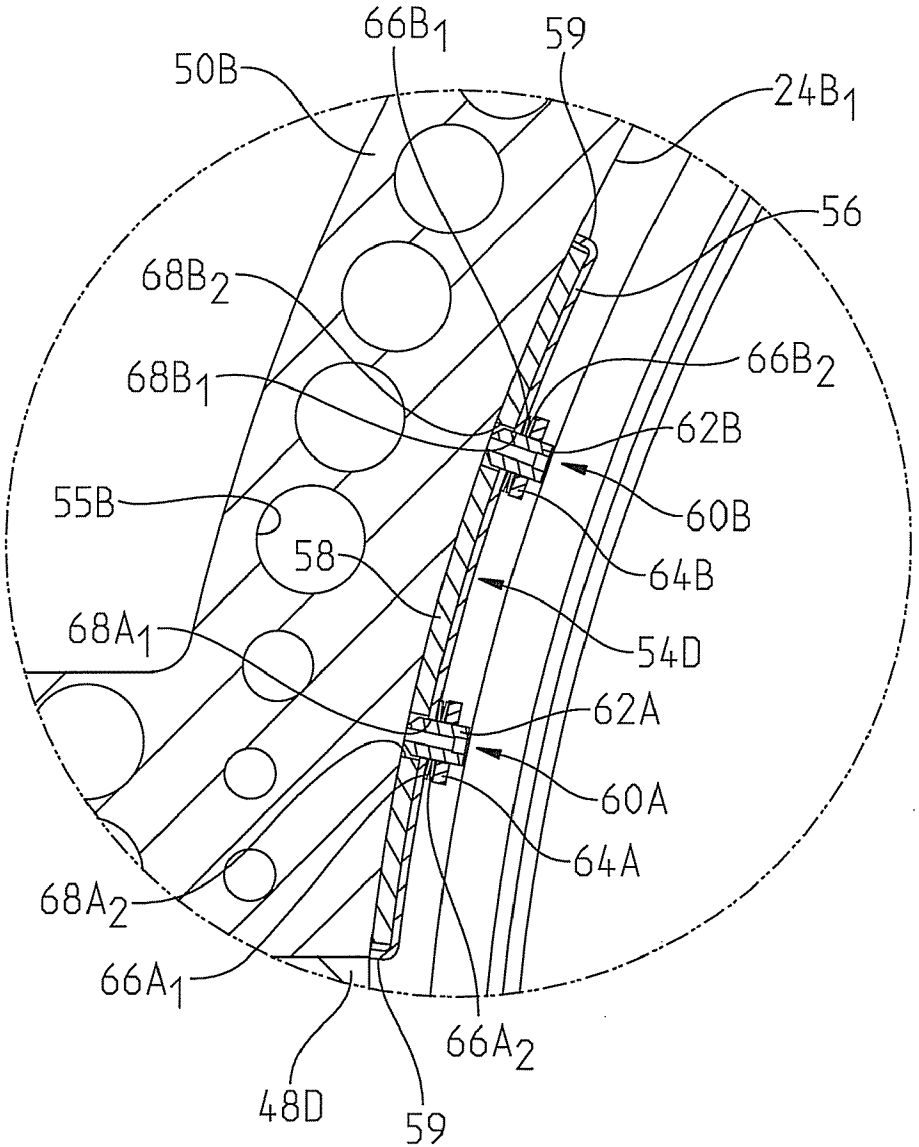
FIG. 4 is an enlarged cross sectional view illustrating an attachment of one of the thermal shields illustrated in FIGS. 2 and 3 to the turbine casing.

FIG. 4 illustrates the fourth thermal shield 54D in detail. It should be understood that the other thermal shields 54A, 54B, 54C, 54E, 54F (and the seventh and eighth thermal shields) are substantially similar to the fourth thermal shield 54D but will not be described in detail herein. The fourth thermal shield 54D comprises a cover structure 56 that covers a portion of the radially inner surface $24B_1$ of the second turbine casing component 24B, i.e., the covered portion of the radially inner surface $24B_1$ of the second turbine casing component 24B. The cover structure 56 is formed from a high strength and heat tolerant material, and is preferably formed from the same material as that of the second turbine casing component 24B. The cover structure 56 in the embodiment shown has a generally rectangular shape and is elongated in the circumferential direction, as shown in FIG. 2.

The fourth thermal shield 54D also comprises a thermally insulating layer 58 (see FIG. 4) that is disposed between the cover structure 56 and the covered portion of the radially inner surface $24B_1$ of the second turbine casing component 24B. In the embodiment shown, the thermally insulting layer 58 comprises a compressible fibrous thermal blanket but may comprise any suitable thermally insulating material, such as, for example, fiberglass.

The circumferential and axial shape of the thermally insulting layer 58 preferably generally corresponds to the circumferential and axial shape of the corresponding cover structure 56. However, the size of the corresponding cover structure 56 may be slightly greater than the size of the thermally insulting layer 58 so as to encapsulate the thermally insulting layer 58 between the cover structure 56 and the second turbine casing component 24B, as shown in FIG. 4, i.e., sidewalls 59 of the cover structure 56 extend around the entire circumference of the thermally insulting layer 58, although it is understood that the sidewalls 59 may extend around only desired portions of the circumference of the thermally insulting layer 58. Further, the thermally insulting layer 58 is preferably oversized in the radial direction such that the thermally insulting layer 58 is compressed between the cover structure 56 and the second turbine casing component 24B and such that there are no gaps having a dimension in the radial direction between the thermally insulting layer 58 and the cover structure 56 and between the thermally insulting layer 58 and the second turbine casing component 24B.

In the embodiment shown in FIG. 4, the fourth thermal shield 54D is attached to the turbine casing 24 via two fastening mechanisms 60A, 60B that each comprise a pin 62A, 62B, a washer 64A, 64B, and one or more springs. The springs are depicted as first springs 66$A_1$, 66$A_2$ and second springs 66$B_1$, 66$B_2$ and may comprise, for example, belleville washers that are associated with respective ones of the fastening mechanisms 60A, 60B shown in FIG. 4. The pins 62A, 62B each extend through a respective aperture 68$A_1$, 68$B_1$ formed in the cover structure 56 and through a respective aperture 68$A_2$, 68$B_2$ formed in the thermally insulating layer 58. The pins 62A, 62B are affixed to the radially inner surface 24$B_1$ of the second turbine casing component 24B, such as, for example, by welding. The springs 66$A_1$, 66$A_2$, 66$B_1$, 66$B_2$ can be pre-loaded, i.e., slightly compressed, with the washers 64A, 64B, which may be welded in place on the pins 62A, 62B so as to securely hold the fourth thermal shield 54D in place while allowing an amount of thermal expansion/contraction of the fourth thermal shield 54D in the radial direction, i.e., the fourth thermal shield 54D may expand in the radial direction thus compressing the springs 66$A_1$, 66$A_2$, 66$B_1$, 66$B_2$, and the fourth thermal shield 54D may contract in the radial direction thus extending the springs 66$A_1$, 66$A_2$, 66$B_1$, 66$B_2$.

During operation of the engine 10, the thermal shields 54A, 54B, 54C, 54D, 54E, 54F effect a reduced amount of thermal stress induced on the covered portions of the C/C or turbine casings 22, 24. Specifically, the thermal shields 54A, 54B, 54C, 54D, 54E, 54F substantially prevent the relatively hot compressor discharge air (i.e., approximately 400° C.) flowing through the inner volume defined by the C/C and turbine casings 22, 24 from contacting the covered portions of the respective casing components 22A, 22B, 24A, 24B. Instead, the compressor discharge air contacts the cover structure 56 of each of the thermal shields 54A, 54B, 54C, 54D, 54E, 54F rather than the covered portions of the casing components 22A, 22B, 24A, 24B. Moreover, the thermally insulting layer 58 of each of the thermal shields 54A, 54B, 54C, 54D, 54E, 54F absorbs additional thermal energy to further reduce the thermal stress induced on the covered portions of the casing components 22A, 22B, 24A, 24B.

During operation of prior art engines, it has been determined that thermal stress induced on the casing components 22A, 22B, 24A, 24B may cause cracking of the casing components 22A, 22B, 24A, 24B proximate to interfaces between the axially extending junctions 29A, 29B, 49A, 49B and the circumferentially extending junction 52 (hereinafter referred to as "problem areas"). The cracking is believed to result from the problem areas being subjected to high amounts of thermal stress, especially during engine load-up and shut down. Specifically, during engine load-up, the temperature of the air in the inner volume defined by the C/C and turbine casings 22, 24 rises very quickly, i.e., the temperature increases from an ambient temperature to around 400° Celsius in about 20 minutes, while the temperature of the air outside of the casings 22, 24 rises much more slowly, i.e., the temperature may take several hours to substantially increase from the ambient temperature. The drastic increase in temperature inside the C/C and turbine casings 22, 24, compared to the relatively smaller temperature increase outside the C/C and turbine casings 22, 24 causes a thermal gradient that induces a large amount of thermal stress in the C/C and turbine casings 22, 24, especially in the problem areas.

A reduced thermal transfer with associated reduced thermal stress induced on the covered portions of the casing components 22A, 22B, 24A, 24B, which are preferably proximate to the problem areas, is effected by the thermal shields 54A, 54B, 54C, 54D, 54E, 54F of the current invention and is believed to substantially reduce cracking of the casing components 22A, 22B, 24A, 24B in and around the problem areas. Specifically, the thermal gradient between the radially inner surfaces 22$A_1$, 22$B_1$ 24$A_1$, 24$B_1$ of the respective casing components 22A, 22B, 24A, 24B and the radially outer surfaces 22$A_2$, 22$B_2$ 24$A_2$, 24$B_2$ of the respective casing components 22A, 22B, 24A, 24B proximate to the respective covered portions of the casing components 22A, 22B, 24A, 24B is reduced as a result of the thermal shields 54A, 54B, 54C, 54D, 54E, 54F absorbing thermal energy and decreasing the thermal transfer rate during engine load-up and shut down. Accordingly, the service life of the respective casing components 22A, 22B, 24A, 24B is believed to be increased, thus, reducing the need for expensive and time consuming repair/replacement procedures to the C/C and turbine casings 22, 24.

Figure 5:
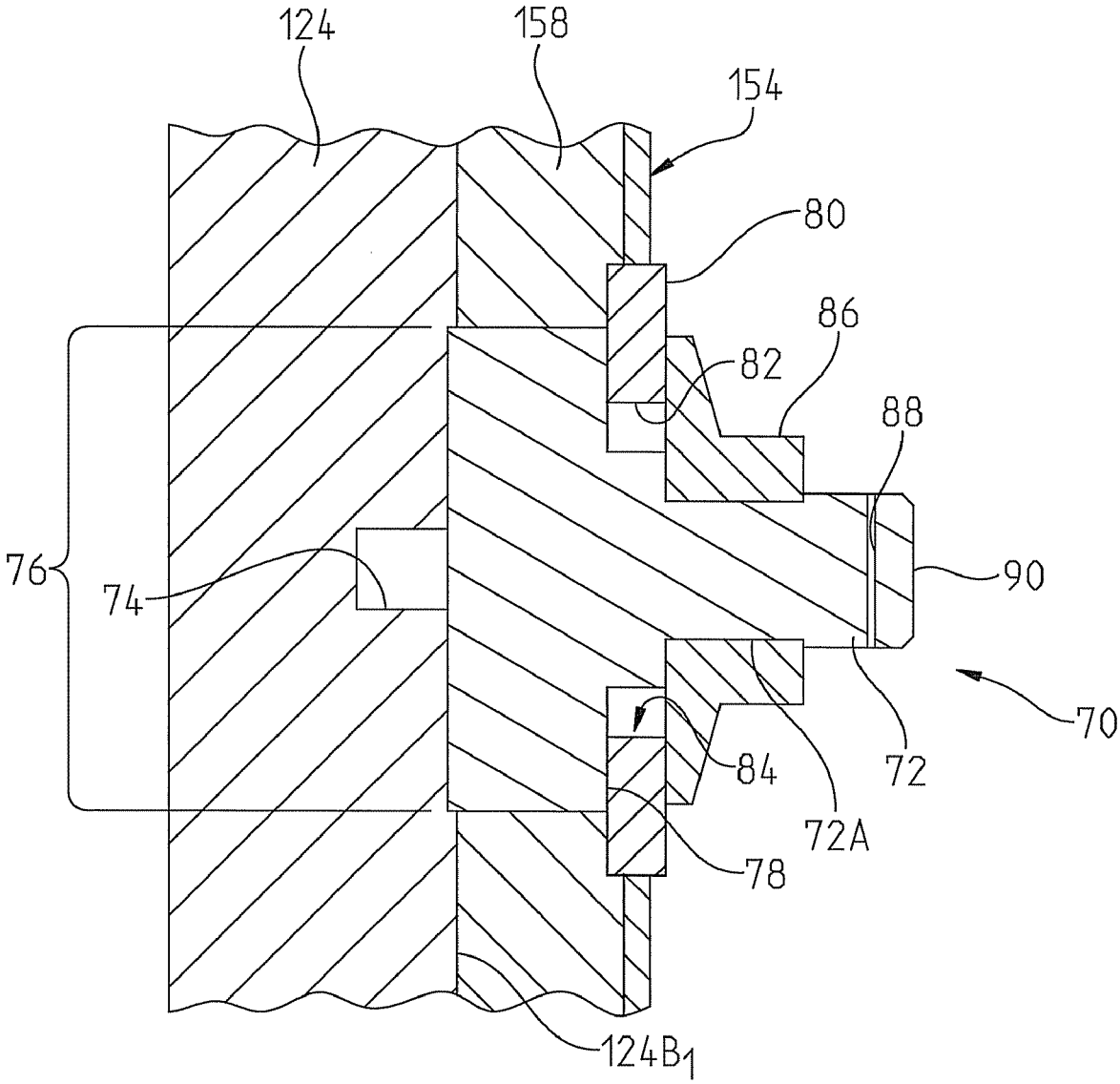
FIG. 5 is an enlarged cross sectional view illustrating an attachment of one of the thermal shields to the turbine casing according to another embodiment of the invention.

Referring now to FIG. 5, an alternate configuration for attaching a thermal shield 154 to a turbine casing 124 is shown, wherein elements corresponding to elements of the first described embodiment (FIGS. 1-4) are identified by the same reference numeral increased by 100. In this embodiment, a fastening mechanism 70 comprises a stud 72 that is affixed to the turbine casing 124, such as, for example, by welding. The stud 72 can be visually aligned on the turbine casing 124 by positioning the stud 72 over an aperture or detent 74, which may be machined or otherwise formed into an inner surface 124$B_1$ of the turbine casing 124. The inner surface 124$B_1$ of the turbine casing 124 may also include a slightly recessed portion 76 for receiving the stud 72.

The stud 72 includes a shoulder 78 for receiving the thermal shield 154, which, in this embodiment, includes a generally circular thickened portion 80 that is positioned on the shoulder 78 of the stud 72. It is noted that the thickened portion 80 may be a separate piece of material that is joined to, i.e., welded to, the remainder of the thermal shield 154, as shown in FIG. 5, or may be integrally formed with the remainder of the thermal shield 154. The thickened portion 80 facilitates an increase in the mechanical strength of the thermal shield 154, so as to avoid damage to the thermal shield 154, i.e., during installation of the thermal shield 154 and/or operation of the engine. An aperture 82 defined in the thickened portion 80 of the thermal shield 154 for being inserted onto the stud 72 may be slightly oversized, as shown in FIG. 5, such that a gap 84 is formed between the thermal shield 154 and the stud 72. The gap 84 may accommodate thermal contraction/expansion of the thermal shield 154 and/or the stud 72, such as may occur during operation of the engine.

A nut 86 or other suitable fastening structure is fastened onto the stud 72, which may include a threaded surface 72A for threadedly receiving the nut 86 thereon. The nut 86 is tightened over the thickened portion 80 of the thermal shield 154 to secure the thermal shield 154 in place. An aperture 88 may be formed through the stud 72 proximate an end 90 of the stud 72 for receiving a nut retaining structure (not shown), such as, for example, a tie wire, therein. The nut retaining structure can be used for maintaining the nut 86 on the stud 72.

As in the embodiment described above for FIGS. 1-4, a thermally insulating layer 158 is disposed between the thermal shield 154 and the turbine casing 124 for decreasing the amount of thermal stress induced on the turbine casing 124 and therefore substantially reducing cracking of the covered portion and adjacent areas, i.e., the problem areas, of the turbine casing 124.

Figure 6:
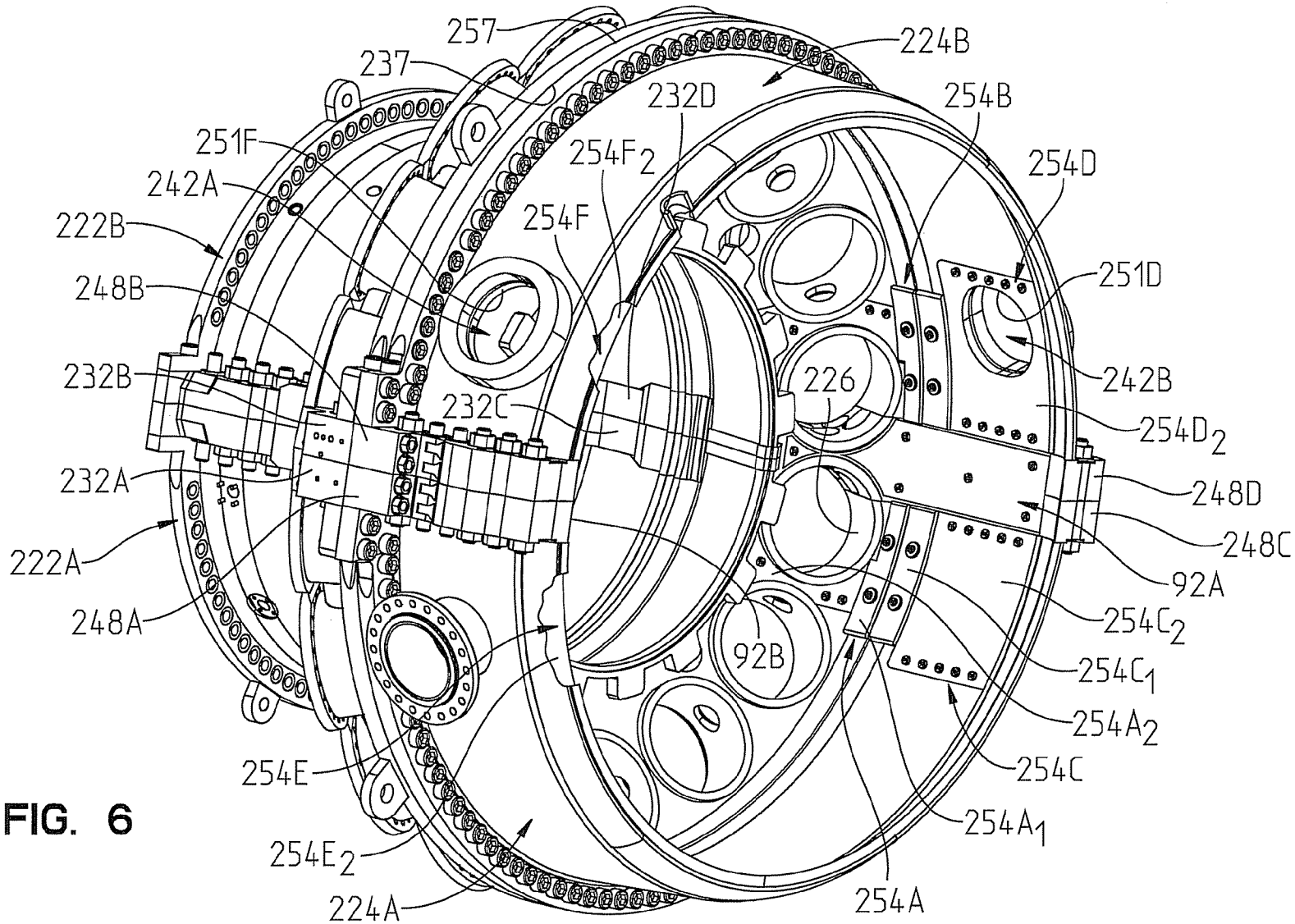
FIG. 6 is a perspective view of portions of a compressor/combustor casing and a turbine casing including thermal shields according to another embodiment of the invention.

Referring now to FIG. 6, a configuration according to another embodiment of the invention is shown, wherein elements corresponding to elements of the first described embodiment (FIGS. 1-4) are identified by the same reference numeral increased by 200. In this embodiment, thermal shields 254A, 254B, 254C, 254D, 254E, 254F (note that two of the thermal shields are hidden from view in FIG. 6) cover a larger portion of respective casing components 222A, 222B, 224A, 224B. Additionally, the thermal shields 254A, 254B, 254C, 254D, 254E, 254F comprise multiple individual pieces that each covers a section of the covered portion of the respective casing components 222A, 222B, 224A, 224B.

A first thermal shield 254A includes a first portion 254$A_1$ and a second portion 254$A_2$. The first portion 254$A_1$ is substantially similar to the first thermal shield 54A illustrated above for FIGS. 1-4. The second portion 254$A_2$ extends axially away from a C/C casing aft end 237 and extends around a respective one of an opening 226 for receiving a combustor (not shown). The first and second portions 254$A_1$, 254$A_2$ may be affixed to the C/C casing component 222A in a similar manner as described above (i.e., the embodiment described for FIGS. 1-4 or the embodiment described for FIG. 5), or in any other suitable manner.

A second thermal shield 254B, along with an additional two thermal shields which are hidden from view and are on the opposed sides of the C/C casing components 222A, 222B, are generally configured as mirror images of the first thermal shield 254A and will not be described in detail herein.

A third thermal shield 254C includes a first portion 254$C_1$ and a second portion 254$C_2$. The first portion 254$C_1$ is substantially similar to the third thermal shield 54C illustrated above for FIGS. 1-4. The second portion 254$C_2$ is formed with a generally rectangular configuration and extends axially away from a turbine casing forward end 257. The first and second portions 254$C_1$, 254$C_2$ may be affixed to the turbine casing component 224A in a similar manner as described above (i.e., the embodiment described for FIGS. 1-4 or the embodiment described for FIG. 5), or in any other suitable manner.

Fourth, fifth, and sixth thermal shields 254D, 254E, 254F, are generally configured as mirror images of the third thermal shield 254C, with the exception of the fourth, fifth, and sixth thermal shields 254D, 254E, 254F additionally including openings. Specifically, the fourth thermal shield 254D includes a shield opening 251D formed in a second shield portion 254$D_2$ and extending around a man way opening 242B, and the sixth thermal shield 254F includes a shield opening 251F formed in a second shield portion 254$F_2$ and extending around a man way opening 242A. In addition, the fifth thermal shield 254E may also be formed with an opening (not shown) formed in a second shield portion 254$E_2$ and extending around an air extraction conduit 243.

Further, the configuration illustrated in FIG. 6 includes additional thermal shields 92A and 92B that cover respective portions of axial C/C casing flanges 232A, 232B and 232C, 232D of the C/C casing components 222A, 222B. In addition, the thermal shields 92A, 92B extend over respective portions of the axial turbine casing flanges 248A, 248B and 248C, 248D of the turbine casing components 224A, 224B. The additional thermal shields 92A, 92B may be affixed to the respective axial C/C casing flanges 232A, 232B and 232C, 232D and axial turbine casing flanges 248A, 248B and 248C, 248D in a similar manner as described above (i.e., the embodiment described for FIGS. 1-4 or the embodiment described for FIG. 5), or in any other suitable manner.

The additional area covered by the thermal shields 254A, 254B, 254C, 254D, 92A, 92B according to this embodiment decreases the amount of thermal stress induced on a larger portion of the respective casing components 222A, 222B, 224A, 224B, and thus may further increase the service life of the respective C/C and turbine casings 222, 224.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A thermal shield for reducing thermal stress induced proximate to a first joint formed between adjacent engine casing components in a gas turbine engine, the thermal shield comprising:

a cover structure for covering a radially inner portion of at least one of the engine casing components, said cover structure disposed proximate to the first joint and attached to a radially inner side of a respective engine casing component so as to limit exposure of the covered inner portion of the respective engine casing component to hot gases in an interior volume defined by the engine casing components; and a thermally insulating layer between said cover structure and the covered inner portion of the respective engine casing component, said thermally insulating layer effecting a reduced amount of heat transfer to the covered inner portion of the respective engine casing component from the hot gases in the interior volume defined by the engine casing components.

2. The thermal shield according to claim 1, wherein said thermally insulating layer comprises a thermal blanket.

3. The thermal shield according to claim 2, wherein said thermal blanket comprises a compressible material.

4. The thermal shield according to claim 2, wherein said thermal blanket comprises a fibrous material.

5. The thermal shield according to claim 1, wherein said thermally insulating layer comprises substantially the same axial and circumferential shape as said cover structure.

6. The thermal shield according to claim 1, wherein said thermally insulating layer is oversized in a radial direction such that there is no gap having a dimension in the radial direction between said thermally insulating layer and said cover structure and such that there is no gap having a dimension in the radial direction between said thermally insulating layer and the respective engine casing component.

7. The thermal shield according to claim 1, wherein the first joint is a circumferentially extending joint between a compressor/combustor casing component and a turbine casing component.

8. The thermal shield according to claim 1, wherein said cover structure is attached to said radially inner side of the respective engine casing component proximate to a second joint, said second joint comprising an axial joint that is formed between adjacent circumferential casing components.

9. The thermal shield according to claim 8, wherein the adjacent circumferential casing components cooperate to form one of a compressor/combustor casing component and a turbine casing component.

10. The thermal shield according to claim 1, wherein the engine casing components form a pair of axially adjacent, generally cylindrical walls about a longitudinal axis of the gas turbine engine, each of said cylindrical walls defining an inner surface and an outer surface, the covered inner portion comprising at least one of said inner surfaces.

11. The thermal shield according to claim 1, wherein said cover structure comprises a generally rectangular member elongated in a circumferential direction.

12. An engine casing for use in a gas turbine engine comprising:

two axially adjacent engine casing structures cooperating to form a substantially cylindrical member defining an interior volume therein, each engine casing structure comprised of at least one circumferential engine casing component, wherein a circumferentially extending joint is formed between said two axially adjacent engine casing structures;

at least one thermal shield for reducing thermal stress induced on a portion of at least one of said engine casing components of said two axially adjacent engine casing structures proximate to said circumferentially extending joint, said thermal shield comprising:

a cover structure for covering a radially inner portion of said at least one of said engine casing components, said cover structure disposed proximate to said circumferentially extending joint and attached to a radially inner side of a respective engine casing component so as to limit exposure of the covered inner portion of the respective engine casing component to hot gases in said interior volume defined by said two axially adjacent engine casing structures; and a thermally insulating layer between said cover structure and the covered inner portion of the respective engine casing component, said thermally insulating layer effecting a reduced amount of heat transfer to the covered inner portion of the respective engine casing component from the hot gases in said interior volume defined by said two axially adjacent engine casing structures.

13. The engine casing according to claim 12, wherein said thermally insulating layer comprises a thermal blanket formed from a compressible, fibrous material.

14. The engine casing according to claim 12, wherein said thermally insulating layer comprises substantially the same axial and circumferential shape as said cover structure and is oversized in a radial direction such that there is no gap having a dimension in the radial direction between said thermally insulating layer and said cover structure and such that there is no gap having a dimension in the radial direction between said thermally insulating layer and the respective engine casing component.

15. The engine casing according to claim 12, wherein said two axially adjacent engine casing structures comprise a compressor/combustor casing component and a turbine casing component.

16. The engine casing according to claim 12, wherein said cover structure is attached to said radially inner side of the respective engine casing component proximate to a second joint, said second joint comprising an axial joint that is formed between adjacent circumferential casing components.

17. The engine casing according to claim 12, wherein said engine casing components form a pair of axially adjacent, generally cylindrical walls about a longitudinal axis of the gas turbine engine, each of said cylindrical walls defining an inner surface and an outer surface, the covered inner portion comprising at least one of said inner surfaces.

18. An engine casing for use in a gas turbine engine comprising:

a first engine casing structure comprising at least two first engine casing components, wherein an axially extending joint is formed between each of said first engine casing components;

a second engine casing structure disposed axially adjacent to said first engine casing structure and comprising at least two second engine casing components, wherein an axially extending joint is formed between each of said second engine casing components, said first and second engine casing structures cooperating to define an interior volume therein, wherein a circumferentially extending joint is formed between said first and second engine casing structures;

wherein each of said first engine casing components and each of said second engine casing components has a respective thermal shield associated with it for reducing thermal stress induced on said first and second engine casing components, each of said thermal shields comprising:

a cover structure for covering a radially inner portion of the respective engine casing component, said cover structure disposed proximate to said circumferentially extending joint between said first and second engine casing structures and also proximate to said axially extending joint between the respective engine casing components, said cover structure attached to a radially inner side of a respective engine casing component so as to limit exposure of the covered inner portion of the respective engine casing component to hot gases in said interior volume defined by said first and second engine casing structures.

19. The engine casing according to claim 18, including a thermally insulating layer between each said cover structure and the covered inner portion of the respective engine casing component, said thermally insulating layer effecting a reduced amount of heat transfer to the covered inner portion of the respective engine casing component from the hot gases in said interior volume defined by said first and second engine casing structures, said thermally insulating layer comprising a thermal blanket formed from a compressible, fibrous material, said thermal blanket comprising substantially the same axial and circumferential shape as said cover structure and being oversized in a radial direction such that there is no gap having a dimension in the radial direction between said thermal blanket and said cover structure and such that there is no gap having a dimension in the radial direction between said thermal blanket and the respective engine casing component.

20. The engine casing according to claim 18, wherein said first engine casing structure comprises a compressor/combustor casing and said second engine casing structure comprises a turbine casing structure.

* * * * *